US006579132B2

(12) United States Patent
Sato et al.

(10) Patent No.: US 6,579,132 B2
(45) **Date of Patent: *Jun. 17, 2003**

(54) ELECTRICAL CONTACT

(75) Inventors: Naotoshi Sato, Shizuoka (JP); Masaya Yamamoto, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/456,834

(22) Filed: Dec. 7, 1999

(65) Prior Publication Data

US 2002/0160666 A1 Oct. 31, 2002

(30) Foreign Application Priority Data

Dec. 8, 1998 (JP) ..... 10-348233

(51) Int. Cl.[7] ..... H01R 13/11
(52) U.S. Cl. ..... 439/852
(58) Field of Search ..... 439/850–852, 439/842, 843, 845

(56) References Cited

U.S. PATENT DOCUMENTS

| | | | | | |
|---|---|---|---|---|---|
| 5,551,897 | A | * | 9/1996 | Alwine | 439/852 |
| 5,685,746 | A | * | 11/1997 | Maejima | 439/852 |
| 5,733,155 | A | * | 3/1998 | Sagawa | 439/852 |
| 5,897,404 | A | * | 4/1999 | Goodman et al. | 439/851 |
| 6,102,752 | A | * | 8/2000 | Bommel et al. | 439/852 |

FOREIGN PATENT DOCUMENTS

| | | |
|---|---|---|
| JP | Hei 7-296886 | 11/1995 |
| JP | 10189102 | 7/1998 |

* cited by examiner

*Primary Examiner*—Hien Vu
(74) *Attorney, Agent, or Firm*—Morgan, Lewis & Bockius LLP

(57) ABSTRACT

An electrical contact includes a tubular portion, and a contact piece portion which is provided within the tubular portion so as to contact a contact portion of a mating connector terminal, inserted into the tubular portion through one open end thereof, to be electrically connected to the contact portion. The contact piece portion is supported by a contact piece portion-interconnecting portion, extending from an edge of the other open end of the tubular portion, in such a manner that the contact piece portion is held out of contact with an inner surface of the tubular portion.

2 Claims, 5 Drawing Sheets

ELECTRICAL CONTACT

BACKGROUND OF INVENTION

1. Field of Invention

This invention relates to an electrical contact for connection to a mating connector.

2. Related Art

An electrical contact is used at a region where it is connected to a terminal of a mating connector, and specifically such an electrical contact is used within a connector, various kinds of connection boxes and so on.

There are occasions when such electrical contacts are used in an environment (for example, in a transportation vehicle such as an automobile) in which vibrations are applied to these electrical contacts. In this case, an electrical contact point portion of the electrical contact, contacted with a mating connector, slightly (finely) slides, and this results in a problem that the contact point is worn, so that the electric resistance of the contact point increases.

This will be described with reference to FIG. 7. FIG. 7 shows a connector terminal y having an electrical contact portion 30 (shown in cross-section). An extension portion extends from a front end (facing in a direction of connection with a mating connector) of a bottom portion of a box-shaped portion 31, and is bent to form a spring portion 32*a* at a front end portion of the box-shaped portion and also to form a contact piece portion 32 disposed within the box-shaped portion 31. A contact point portion 32*b* of the contact piece portion 32 is adapted to contact a contact piece portion (not shown) of the mating connector to be electrically connected thereto. An upper contact piece portion 33 is provided at a top wall of the box-shaped portion 31, and is adapted to contact a contact piece portion (not shown) of the mating connector to be electrically connected thereto.

When the terminal γ is subjected to vibrations, the vibration of the box-shaped portion causes a fine sliding movement between the contact piece portion 33 and the contact piece portion of the mating connector. As a result, the contact piece portion of the mating connector vibrates, so that a fine sliding movement also develops between the contact point 32*b* of the contact piece portion 32 and the contact piece portion of the mating connector. As a result of wear of these contact points, the electric resistance increases.

There have been proposed electric connectors which prevent wear due to such fine sliding movement.

One such example is a connector terminal δ shown in FIG. 8.

The connector terminal δ comprises two parts, that is, a box-shaped portion δ1, and a body portion having contact piece portions 40 and a wire connection portion 41. The two portions are integrally connected together through fixing portions 42 and press-clamping portions 43 by pressing. With this integral construction, vibrations, applied from the exterior, are absorbed by spring portions 44, and therefore are hardly transmitted to the contact piece portions 40, so that a fine sliding movement between the contact piece portions 40 and a contact piece portion of a mating connector is prevented. However, this structure comprises the two parts, and besides there is required an apparatus or the like for assembling these parts together, and therefore the production cost is extremely high.

FIG. 9 is a cross-sectional view of a connector terminal ϵ proposed in Japanese Patent Unexamined Publication No. 10-189102.

This terminal is received in a terminal receiving chamber in a connector housing so as to provide an electric connector. This terminal includes an electrical contact portion 50 for connection to a terminal (not shown) of a mating connector, and a wire fixing portion 60 for connection to a wire.

This terminal ϵ is formed by blanking a piece from a flat stock and then by bending it. The appearance of the electrical contact portion 50 is a box-shape, and a resilient contact piece portion 52 is provided within the electrical contact portion 50, and is supported by an interconnecting portion 51 extending from a side wall of the electrical contact portion 50 (see FIG. 10 which is a cross-sectional view taken along the line B—B of FIG. 9).

The resilient contact piece portion 52 is electrically connected at its contact portions 52*a* and 52*b* to a terminal of a mating connector.

Thus, the resilient contact piece portion 52 is supported only by the relatively-narrow interconnecting portion 51 extending from the side wall of the box-shaped portion, and therefore there is achieved an advantage that the amount of fine sliding movement of the contact portions 52*a* and 52*b* relative to the terminal of the mating connector is small.

With the above construction, although the intended effect can be obtained for vibrations in lateral and vertical (upward and downward) directions, a vibration-absorbing effect of the interconnecting portion 51 is not effective for vibrations in a forward-rearward direction a (see FIG. 9). Therefore, the whole of the resilient contact piece portion 52 is turned about the interconnecting portion 51 to vibrate as shown in FIG. 10 (which is a cross-sectional view taken along the line B—B of FIG. 9). Because of this construction, the vibration-absorbing effect is incomplete, and the above problem with respect to the fine sliding movement has not yet been solved.

SUMMARY OF INVENTION

This invention seeks to solve the above problem. More specifically, an object of the invention is to provide an electrical contact which can be formed by one member, and even when vibrations develop in a forward-backward direction (terminal-inserting direction), a trouble, such as the increase of an electric resistance due to a fine sliding movement, will not occur.

The above object has been achieved by an electrical contact of claim 1 including a tubular portion, and a contact piece portion which is provided within the tubular portion so as to contact a contact portion of a mating connector terminal, inserted into the tubular portion through one open end thereof, to be electrically connected to the contact portion; provided in that the contact piece portion is supported by a contact piece portion-interconnecting portion, extending from an edge of the other open end of the tubular portion, in such a manner that the contact piece portion is held out of contact with an inner surface of the tubular portion.

DETAILED DESCRIPTION OF PREFERRED EMBODIMENTS

To serve its intended purpose, it is preferred that an electrical contact of the present invention should comprise one flat member.

It is necessary that a contact piece portion-interconnecting portion should be sufficiently long that it can absorb vibrations of a tubular portion without allowing the vibrations to be transmitted to a contact piece portion. However, it is difficult for the length of the contact piece portion-interconnecting portion to exceed the size of an open end of the tubular portion, and if this length is generally equal to the size of the open end, a sufficient effect can be obtained. If the width of the contact piece portion-interconnecting portion is too large, there is a possibility that the absorption of vibrations is insufficient, and in contrast, if this width is too small, the strength is insufficient.

The electrical contact of the present invention will now be described specifically with reference to the drawings.

Figure 1:
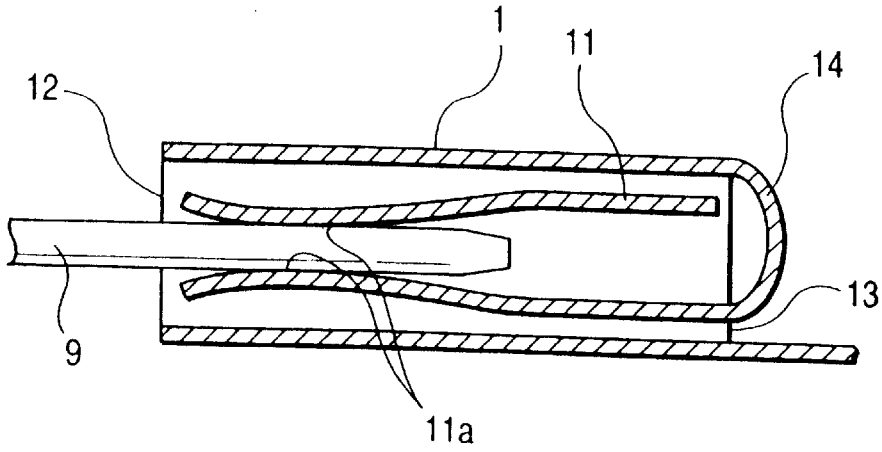
FIG. 1 is a cross-sectional view of an electrical contact of the present invention.

FIG. 1 shows the cross-section of the electrical contact of the present invention, and more specifically shows an electrical contact portion of a connector terminal. This connector terminal is formed by blanking (stamping) a piece from a copper sheet and by bending it. This connector terminal, when developed, takes the form of one flat member, and therefore any process and any apparatus for combining two parts together for assembling purposes are not necessary.

Reference numeral 1 denotes the tubular portion, and in this embodiment, the tubular portion 1 has a square cross-section. The contact piece portion 11 for contact with a contact portion 9 of a mating connector terminal to be electrically connected thereto is provided within the tubular portion 1. The contact portion 9 of the mating connector is inserted into the tubular portion 1 through one open end 12 thereof, and the contact piece portion-interconnecting portion 14 extends from an edge of the other open end 13 of the tubular portion 1, and the contact piece portion 11 is supported by the contact piece portion-interconnecting portion 14 in a suspended manner without contact with an inner surface of the tubular portion 1.

The length of the contact piece portion-interconnecting portion 14 is generally equal to the size of the open end 13 of the tubular portion 1, and the width thereof is relatively small (about a half of the size of the open end 13), but is sufficient to support the contact piece portion 11. Therefore, the contact piece portion-interconnecting portion 14 absorbs all of vibrations of the tubular portion 1, so that these vibrations will not propagate to the contact piece portion 11. Therefore, a fine sliding movement is prevented from developing at points 11*a* of contact between the contact piece portion 11 and the contact portion 9 of the mating connector.

Figure 2:
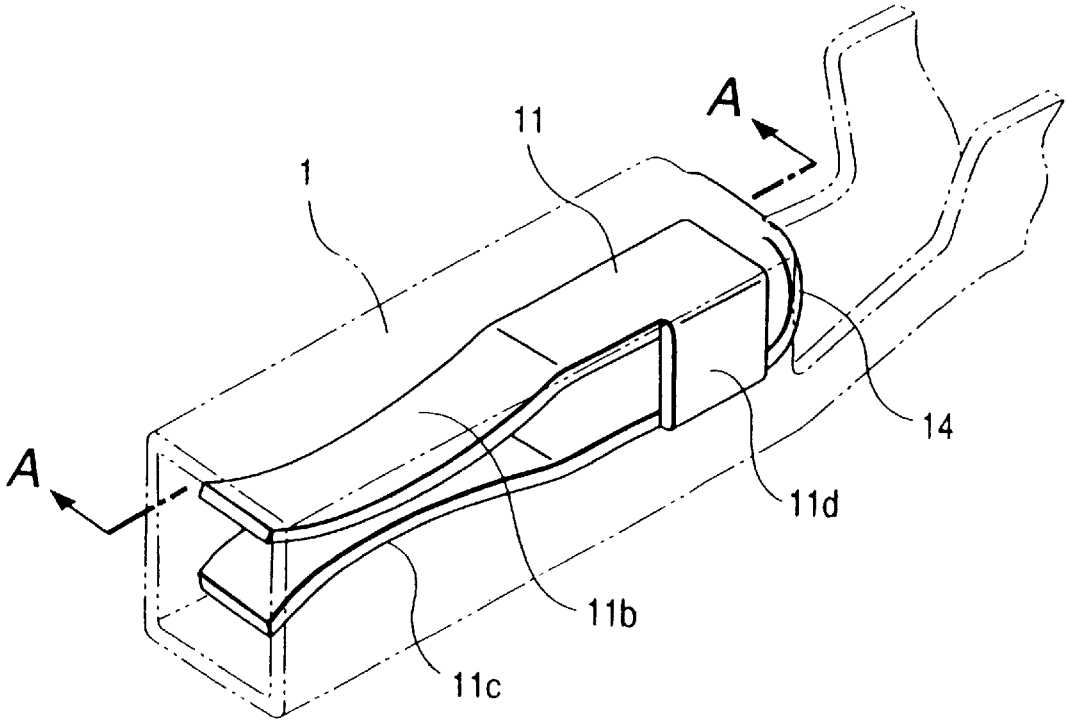
FIG. 2 is a perspective view of an electrical contact portion of FIG. 1 as seen from the upper front side.

FIG. 2 is a perspective view of the electrical contact portion as seen from the upper front side (The front side is in the direction of connection to the mating connector). In this Figure, the contact piece portion 11, provided within the tubular portion 1, is indicated in solid lines.

In this Figure, the tubular portion 1 is indicated in phantom. In order that the contact piece portion 11 can positively contact the contact portion 9 of the mating connector, the contact piece portion 11 includes upper and lower spring portion 11*b* and 11*c* (each performing the function of a spring), and an interconnecting portion 11*d* interconnecting these spring portions. The contact piece portion 11 is connected to the tubular portion 1 by the contact piece portion-interconnecting portion 14.

Figure 3:
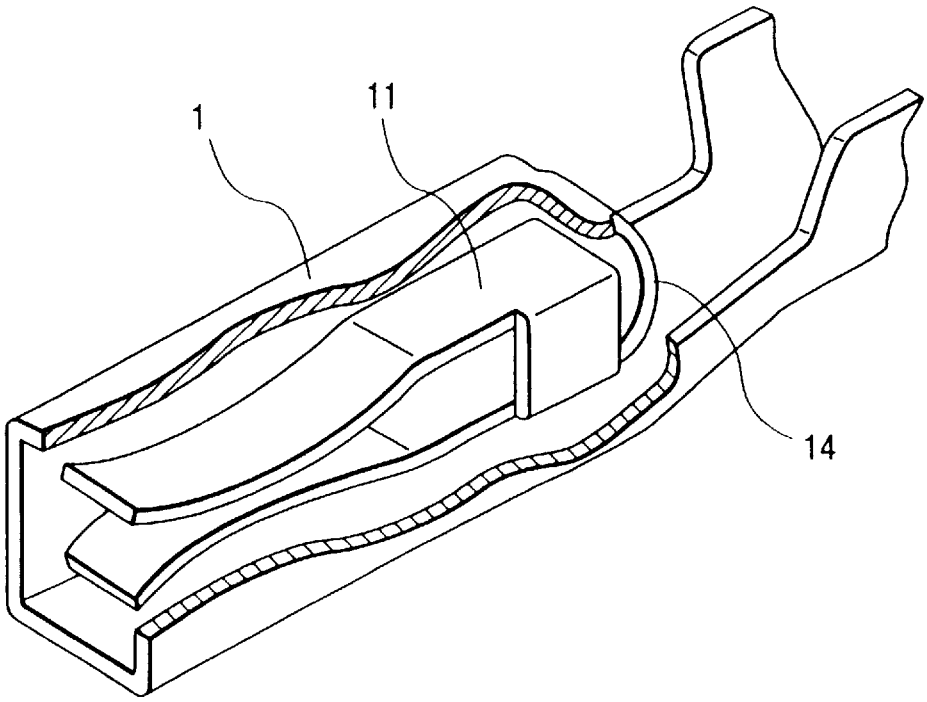
FIG. 3 is a partly-broken, perspective view of the electrical contact portion of FIG. 1 as seen from the upper front side.
Figure 4:
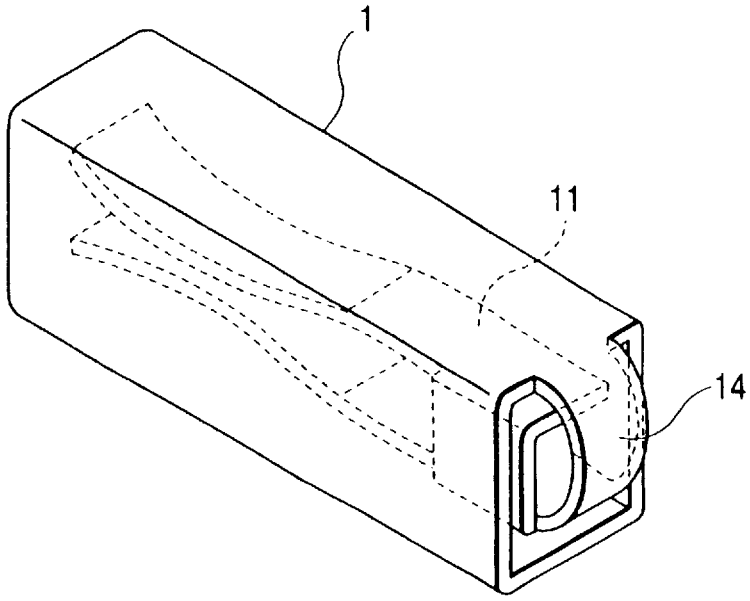
FIG. 4 is a perspective view of the electrical contact portion of FIG. 1, with a portion thereof indicated in phantom, as seen from the upper rear side.

FIG. 3 is a partly-broken, perspective view of the electrical contact portion as seen from the upper front side, and FIG. 4 is a perspective view of the electrical contact portion, with a portion thereof indicated in phantom, as seen from the upper rear side.

Figure 5A:
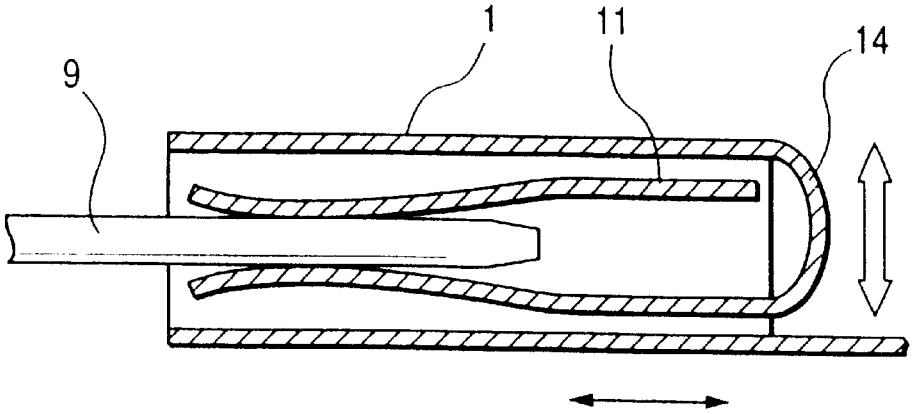
FIGS. 5(*a*) and 5(*b*) are views explanatory of an effect of a contact piece portion-interconnecting portion, FIG. 5(*a*) being a cross-sectional view taken along the line A—A of FIG. 2, and FIG. 5(*b*) being a top plan view of a box-shaped portion.
Figure 5B:
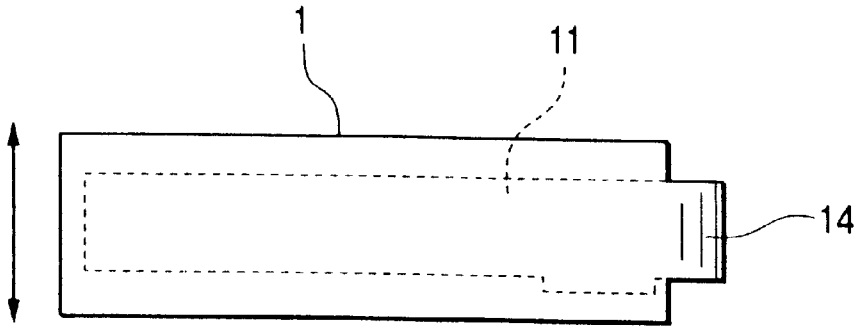

The effect of the contact piece portion-interconnecting portion will be described with reference to FIGS. 5(*a*) and 5(*b*). FIG. 5(*a*) is a cross-sectional view taken along the line A—A of FIG. 2, and FIG. 5(*b*) is a top plan view (The contact piece portion 11 within the tubular portion 1 is indicated in broken lines).

In FIG. 5(*a*), even when the tubular portion 11 vibrates in an upward-downward direction (indicated by a thick arrow) and even when the tubular portion 11 vibrates in a forward-backward direction (indicated by an arrow), the contact piece portion-interconnecting portion 14, serving as a spring, absorbs the vibrations, so that these vibrations will not propagate to the contact piece portion 11. The contact piece portion-interconnecting portion 14 is sufficiently long, and also has the width which is small, but is sufficient to support the contact piece portion 11, and therefore vibrations in a lateral direction (indicated by an arrow in FIG. 5(*b*)) will not propagate to the contact piece portion 11.

With the electrical contact portion of this construction, the contact piece portion, to which vibrations will not propagate, and the box-shaped portion can be formed by one member.

Figure 6:
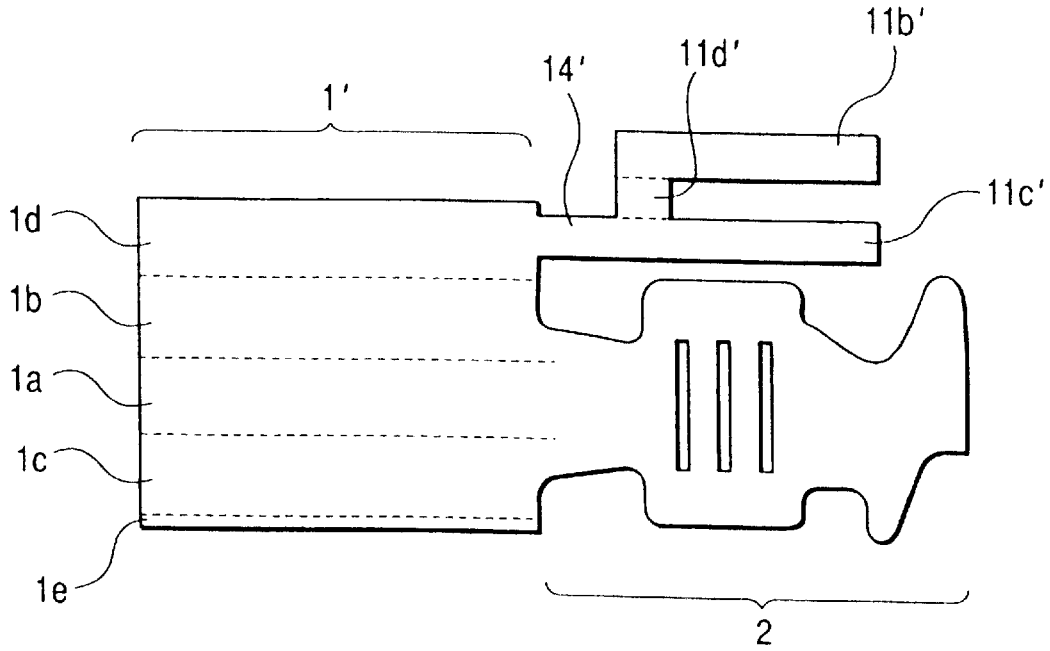
FIG. 6 is a developed view of one example of a connector terminal having the electrical contact portion of FIG. 1.
Figure 7:
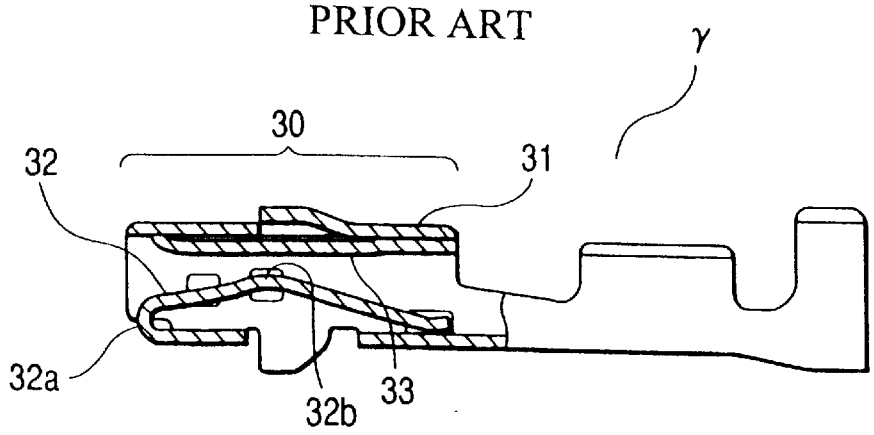
FIG. 7 PRIOR ART
FIG. 7 is a view showing a conventional connector terminal γ.
Figure 8:
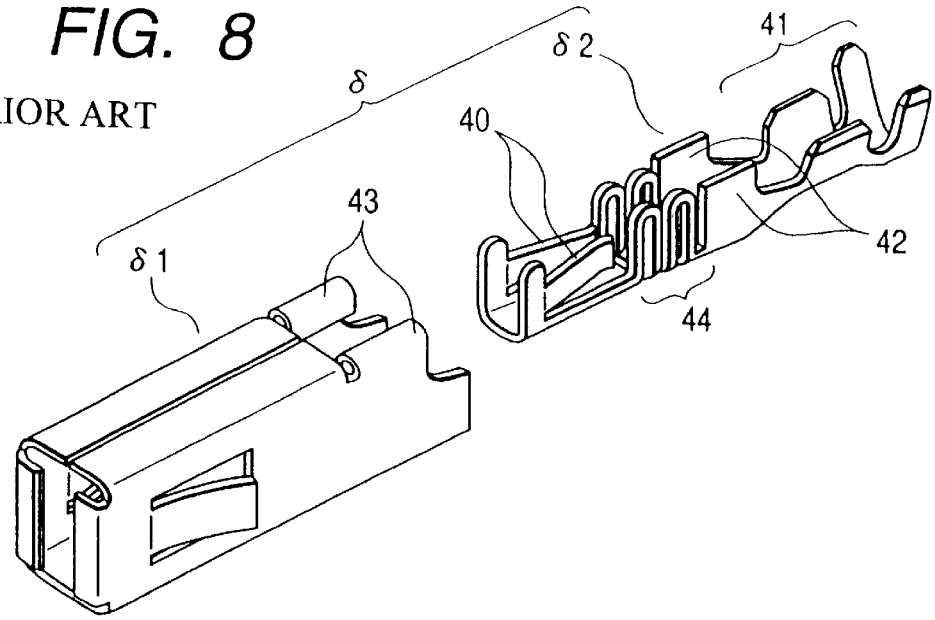
FIG. 8 PRIOR ART
FIG. 8 is a view showing a conventional connector terminal δ.
Figure 9:
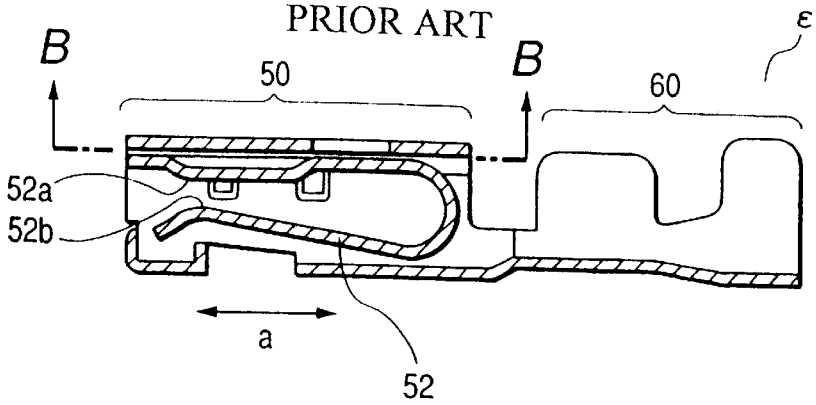
FIG. 9 PRIOR ART
FIG. 9 is a view showing a conventional connector terminal ϵ.
Figure 10:
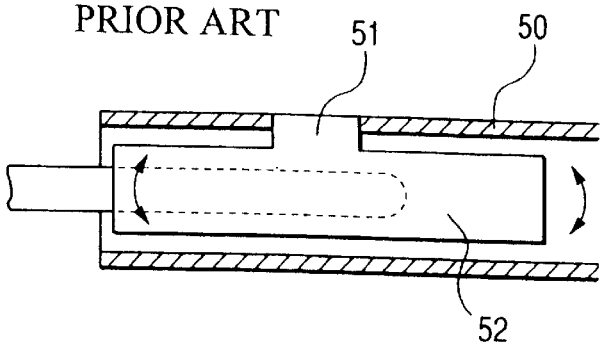
FIG. 10 PRIOR ART
FIG. 10 is a cross-sectional view taken along the line B—B of FIG. 9.

FIG. 6 is a developed view of one example of a connector terminal having such an electrical contact portion.

In FIG. 6, a section 1' is used for forming the tubular portion, a section 1*a* for forming a bottom portion, sections 1*b* and 1*c* for respectively forming a pair of opposite side walls extending upwardly respectively from opposite side edges of the bottom portion, a section 1*d* for forming a top wall extending from an upper edge of the side wall 1*b* toward the side wall 1*c*, and a section 1*e* for forming that portion which extends from an upper edge of the side wall 1*c* toward the side wall 1*b*, and is butted at its distal end (edge) to an edge of the top wall 1*d*.

A section 14' for forming the contact piece portion-interconnecting portion extends from a rear end (forming one open end remote from the other open end into which the mating connector terminal is inserted) of the top wall 1*d*. Sections 11*b*' and 11*c*' for respectively forming the upper and lower spring portions of the contact piece portion, and a section 11*d*' for forming the interconnecting portion, interconnecting these spring portions, are connected to the section 1' by the section 14'.

The sections 1*a*, 1*b* and 1*c*, forming the box-shaped portion of the connector terminal, are connected to a member (section) 2 forming a wire connection portion.

As described above, the electrical contact includes the tubular portion, and the contact piece portion which is provided within the tubular portion so as to contact the contact portion of the mating connector terminal, inserted into the tubular portion through one open end thereof, to be electrically connected to the contact portion, and the contact piece portion is supported by the contact piece portion-interconnecting portion, extending from the edge of the other open end of the tubular portion, in such a manner that the contact piece portion is held out of contact with the inner surface of the tubular portion. With this construction, the electrical contact of the present invention can be formed from one material only by an ordinary processing including blanking and bending operations. Therefore, there can be provided the excellent electrical contact in which the production is easy, and the cost of the assembling apparatus is low, and despite this, wear due to a fine sliding movement can be completely prevented, so that the problem with respect to the increase of the electric resistance of the contact point is solved.

The electrical contact of the present invention can be formed from one material only by an ordinary processing including blanking and bending operations. Therefore, there can be provided the excellent electrical contact in which the production is easy, and the cost of the assembling apparatus is low, and despite this, wear due to a fine sliding movement can be completely prevented, so that the problem with respect to the increase of the electric resistance of the contact point is solved.

What is claimed is:

1. An electrical contact comprising:

a tubular portion having a first open end and a second open end;

a contact piece portion provided within said tubular portion; and a connecting portion for supporting said contact piece portion, said connecting portion extending from an edge of said second open end in such a manner that said contact piece portion is held out of contact with an inner surface of said tubular portion and said connecting portion is spaced from said inner surface of said tubular portion;

wherein the contact piece portion is formed with an upper cantilevered spring portion, a lower cantilevered spring portion and an interconnecting portion connecting said upper and lower spring portions for contacting upper and lower contact portions of a mating connector terminal which is inserted into said tubular portion through said first open end.

2. The electrical contact of claim 1, wherein said interconnecting portion joins said upper and lower spring portions substantially near said second open end of said tubular portion.

* * * * *